US008887917B2

(12) United States Patent
Glass et al.

(10) Patent No.: US 8,887,917 B2
(45) Date of Patent: Nov. 18, 2014

(54) GIFT CARD HOLDER WITH MULTI-FUNCTION INSERT

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 213 days.

(21) Appl. No.: 13/479,019

(22) Filed: May 23, 2012

(65) Prior Publication Data

US 2013/0126371 A1 May 23, 2013

Related U.S. Application Data

(60) Provisional application No. 61/489,229, filed on May 23, 2011.

(51) Int. Cl.
*B65D 73/00* (2006.01)

(52) U.S. Cl.
CPC ..... *B65D 73/0007* (2013.01); *B65D 73/0078* (2013.01)
USPC ..... 206/449; 206/758; 206/232

(58) Field of Classification Search
USPC ..... 206/457, 232, 806, 449, 451, 775, 758, 206/425
See application file for complete search history.

(56) References Cited

U.S. PATENT DOCUMENTS

| | | | | |
|---|---|---|---|---|
| 5,186,326 | A * | 2/1993 | Peckels et al. | 206/234 |
| 5,791,474 | A * | 8/1998 | Hansen | 206/449 |
| 6,715,795 | B2 * | 4/2004 | Klure | 283/62 |
| 7,490,720 | B2 * | 2/2009 | Cole et al. | 206/232 |
| 8,474,162 | B1 * | 7/2013 | Glass | 40/124.03 |
| 2003/0080013 | A1 * | 5/2003 | Smith | 206/449 |
| 2006/0101678 | A1 * | 5/2006 | Wilen | 40/124.06 |
| 2007/0094901 | A1 * | 5/2007 | Kibbe et al. | 40/124.06 |
| 2007/0267313 | A1 * | 11/2007 | McLean | 206/457 |
| 2012/0260542 | A1 * | 10/2012 | Kibbe et al. | 40/124.06 |
| 2013/0153454 | A1 * | 6/2013 | Glass et al. | 206/457 |

* cited by examiner

*Primary Examiner* — Steven A. Reynolds
(74) *Attorney, Agent, or Firm* — Polsinelli PC

(57) ABSTRACT

A transaction card holder for holding a transaction card, such as a gift card, on or within a functional insert that may be withdrawn from an enclosing main body of the holder. In certain embodiments, the insert is shaped and provided with indicia to appear and function as a measuring tape, and the main body of the holder is shaped and decorated to appear as a tape measure housing.

15 Claims, 5 Drawing Sheets

GIFT CARD HOLDER WITH MULTI-FUNCTION INSERT

CROSS REFERENCE TO RELATED APPLICATIONS

This application claims the benefit of the prior filed, provisional application, Ser. No. 61/489,229, filed May 23, 2011.

BACKGROUND OF THE INVENTION

This invention relates generally to card holders and more particularly to a device for holding a transaction card, such as a gift card, on or within an insert that may be withdrawn from an enclosure of the device. In certain embodiments, the insert is shaped and provided with indicia to function as a measuring tape and the main body of the holder is shaped and decorated to appear as a tape measure housing.

Transaction cards, stored value cards, or gift cards, as they are commonly called based upon their intended use, have become popular gifts. Gift cards typically comprise a stored value card whereby a certain cash equivalent value is encoded upon a magnetic strip applied to the surface of the card. This stored value may be determined by the vendor prior to packaging and display for sale or, may be selected at the point of sale by the purchaser and loaded by the cashier using a magnetic card reader/writer. In some cases, the cash value is not stored upon the card itself but is associated with a card identification number and stored in a remote database.

While popular, gift cards are typically provided with a generic and impersonal design, typically identifying the associated merchant for which the card may be used to purchase merchandise, and therefore are not personalized in view of the intended recipient. What is needed, therefore, is a gift card holder that provides graphical and mechanical enhancements to entertain the gift card recipient and add value to the gift.

BRIEF DESCRIPTION OF THE INVENTION

The purpose of this invention is to provide a holder for receiving and holding a gift card. The holder includes a main body typically comprising a front panel and back panel, each substantially flat and planar and of similar size and shape, and joined to one another around the edges to form an enclosure therebetween. As shown in the figures herein, the main body of the disclosed embodiments may be shaped in the outline form of a tape measure. A hang tag projects upward from the top margin of the main body and is separable from the main body along a perforated tear line. The hang tag typically includes a hole, such as the illustrated sombrero-cut hole, for hanging the gift card holder upon a display rack peg. A gift card may be bundled with the gift card holder by attaching the gift card to the main body with removable adhesive or other means. An insert is provided within the enclosure for holding the gift card after the holder is purchased and prior to presenting the holder to a gift recipient. A portion of the insert (referred to herein as a tab) projects out of the enclosure to be grasped by the user to draw the main portion of the insert further out of the enclosure. The insert includes a pocket or other means for receiving and holding the gift card. The insert also includes a measuring scale, whereby the holder not only provides a graphical and decorative enhancement but also provides an element of useful secondary functionality to the gift recipient.

Certain embodiments of a gift card holder may include a main body comprising a first planar panel overlying and adhered or otherwise attached to a second planar panel. The first and second panels, e.g. front and back panels, are typically adhered only, or principally, around their margins so that the first and second panels cooperate when attached to one another to form an interior space or enclosure therebetween. In embodiments in which the first and second panels are substantially cut to the same shape and dimension, the panels are typically placed in substantial alignment with one another at the margins when attached to one another.

The gift card holder includes an insert sized to receive and hold a gift card and to substantially fit within the interior space or enclosure of the main body. The insert is typically placed between the first and second panels prior to attachment of the panels to each other as described above. A slot along the margin of the main body is provided for receiving the insert and to allow passage of the insert from a first position, whereby the insert is substantially within the interior space, to a second position, whereby the insert is substantially withdrawn from the interior space.

A measuring scale on a surface of the insert provides a novel secondary use as the scale may be used to measure items, including measurement use for entertainment purposes. The measurement scale is positioned on the surface of the insert so that the scale may be viewed when the insert is in the second, withdrawn position.

The insert includes means for attaching a gift card to the insert so that the gift card is positioned within the interior space when the insert is in the first position and so that the gift card may be viewed and then detached or removed from the insert when the insert is in the second position. The gift card may be held within a pocket formed in or on the insert or may be attached to the insert via removable adhesive. In a further embodiment, the insert may include slits of a size, number and placement to receive two or more corner portions of the gift card to thereby removably hold the gift card to the insert. The insert also typically includes a means for stopping the insert from being completely withdrawn from the enclosure of the main body.

Other advantages of the invention will become apparent from the following description taken in connection with the accompanying drawings, wherein is set forth by way of illustration and example one or more embodiments of the present invention.

DETAILED DESCRIPTION

Figure 2:
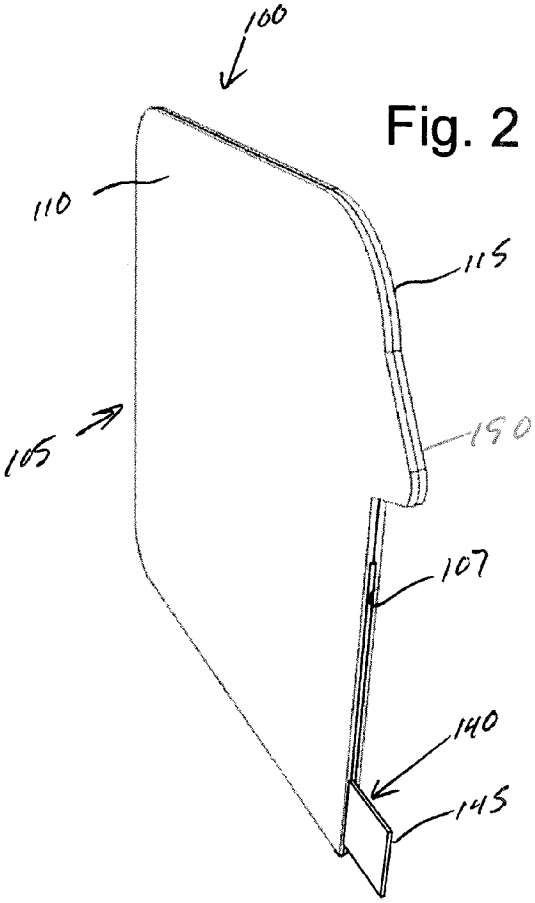
FIG. 2 is a perspective view of the gift card holder of FIG. 1 with the gift card and hang tag elements omitted.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

With reference to the figures, FIGS. 1 through 9 illustrate embodiments of a holder 100 for receiving and holding a gift card 135. The gift card holder 100 includes a main body 105 comprising a front panel 110 and back panel 115, each substantially flat and planar and of similar size and shape, and joined to one another around the edges to form an enclosure therebetween. As shown in the figures, the main body 105 of the disclosed embodiments may be shaped in the outline form of a tape measure or similar measuring device. A hang tag 120 projects upward from the top margin of the main body and is separable from the main body along a perforated tear line 125. The hang tag typically includes a hole 130, such as the illustrated sombrero-cut hole 130, for hanging the gift card holder upon a display rack peg (not shown). A gift card 135 may be bundled with the gift card holder 100 for sale as an integral unit by attaching the gift card 135 to the main body 105 with removable adhesive or other means. In certain embodiments, the gift card 135 may be formed as an extension of the main body 105, similar to the hang tag 120, and in such embodiments the gift card may also be separable from the main body 105 along a perforated tear line.

Figure 1:
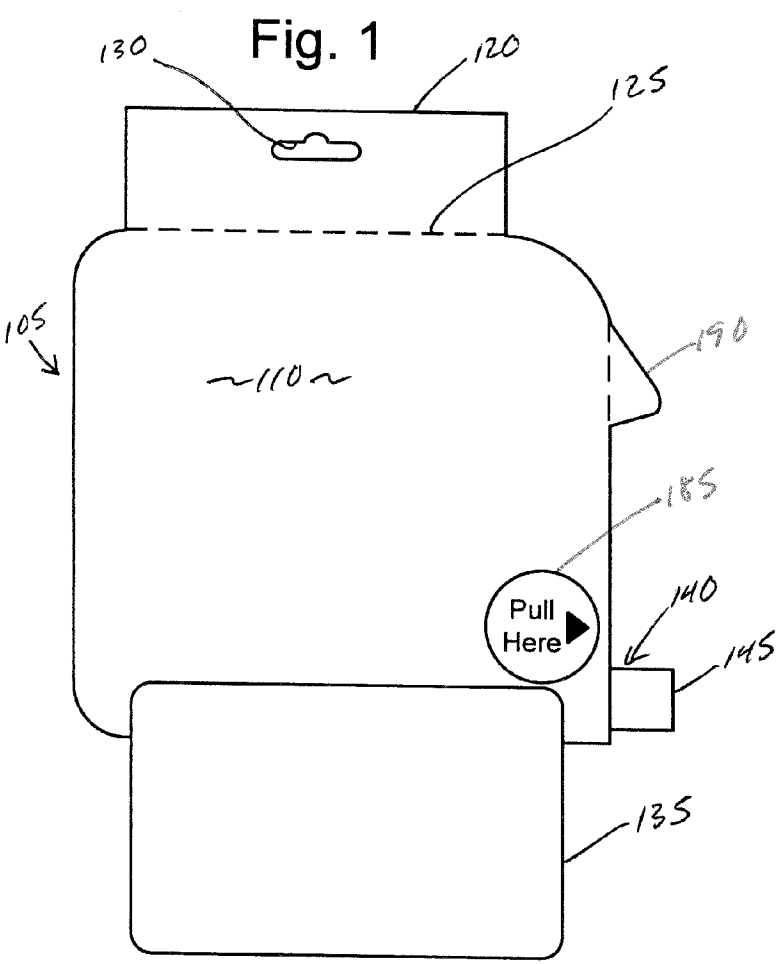
FIG. 1 is a front view of a gift card holder having a main body in the shape of a tape measure housing and including a hang tag and a removably attached gift card.
Figure 3:
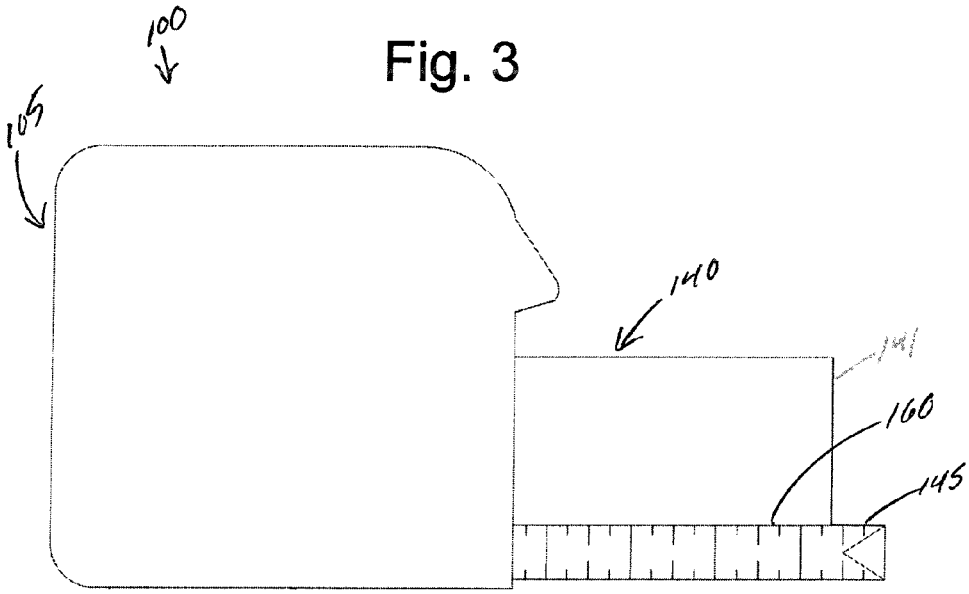
FIG. 3 is a front view of the holder showing the insert withdrawn from the main body.
Figure 4:
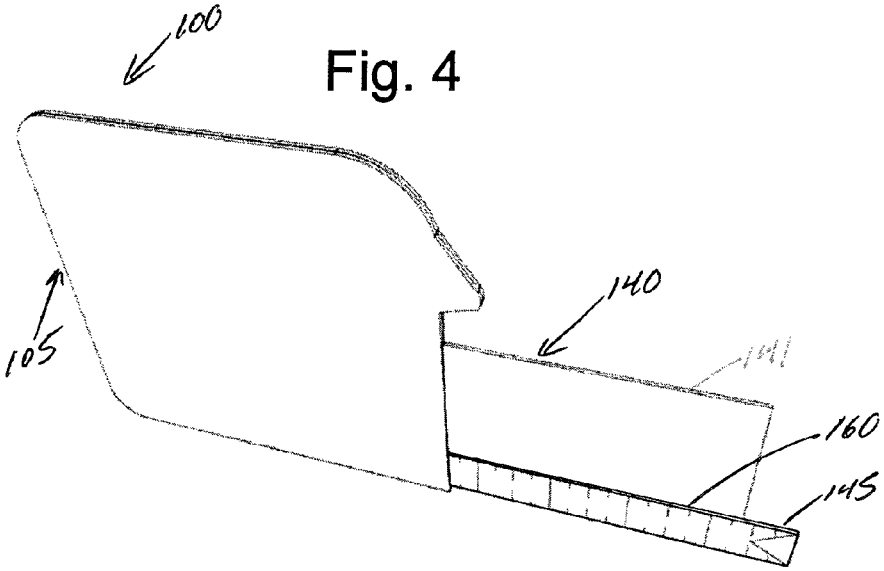
FIG. 4 is a perspective view of the holder of FIG. 3.
Figure 5:
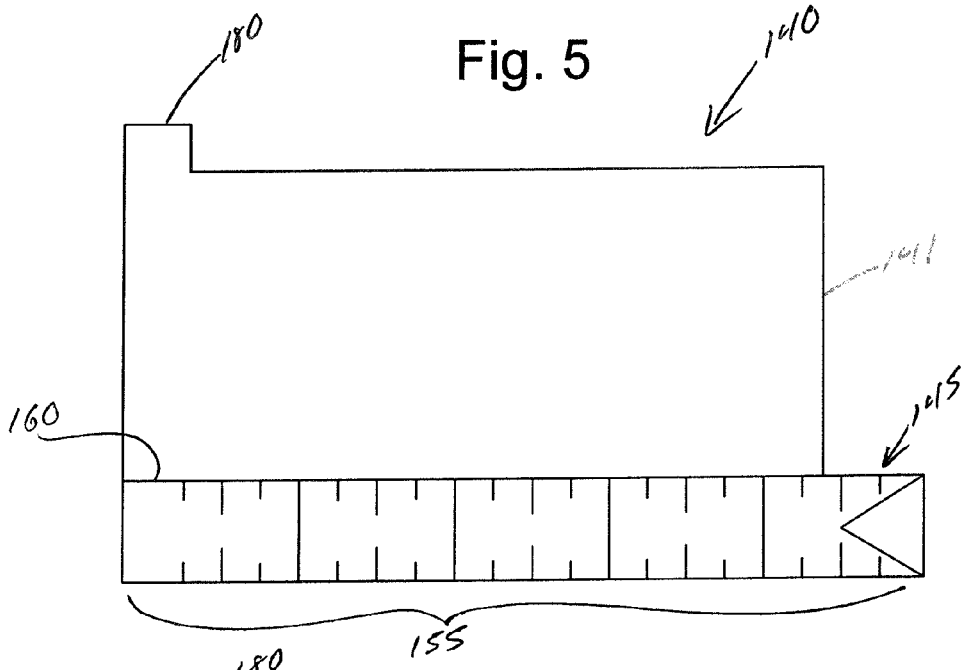
FIG. 5 is a front view of the insert.
Figure 6:
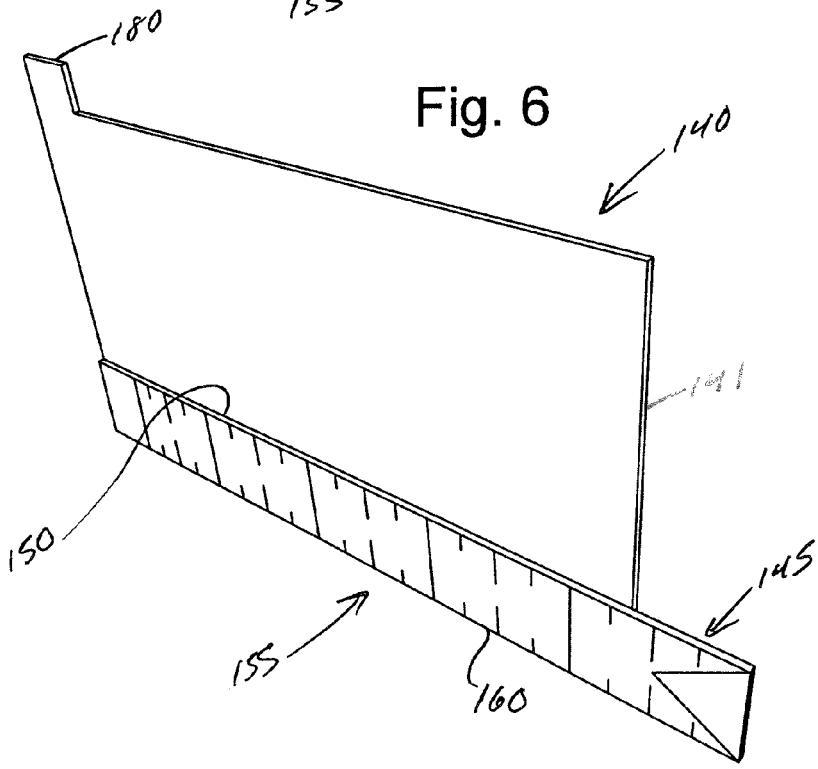
FIG. 6 is a perspective view of the insert.

An insert 140 is provided within the enclosure for holding the gift card 135 after the holder 100 is purchased and prior to presenting the holder 100 to a gift recipient. A portion of the insert 140 (referred to herein as a tab 145) projects out of the enclosure to be grasped by the user to draw the insert 140 further out of the enclosure. FIG. 1 is a front elevation view of the holder 100 showing the tab 145 projecting from the right side of the main body 105 and the gift card 135 removably adhered to the front panel 110. FIG. 2 is a perspective view of the main body 105 and insert 140. FIG. 2 shows an aperture or slot 107 in the right side of the main body 105 which leads to the enclosure and allows the insert 140 to be drawn from within the enclosure. The slot 107 is typically formed by omitting adhesive from between a portion of the front 110 and back 115 panels along the edge of the main body 105 from which the insert 140 is to be withdrawn. FIGS. 3 and 4 are front elevation and perspective views, respectively, that show the insert 140 withdrawn from the main body 105.

The insert 140 includes a pocket 150 (see FIG. 6) or other means for receiving and holding the gift card 135. The insert 140 also includes a measuring scale 155, whereby the holder 100 not only provides a graphical and decorative enhancement but also provides an element of useful secondary functionality to the gift recipient. In the disclosed embodiments, the pocket 150 is formed by folding the elongated measuring portion of the insert (referred to herein as the measuring scale flap 160) upward against the main portion 141 of the insert so that a gift card 135 may be partially inserted and held therebetween.

Figure 8:
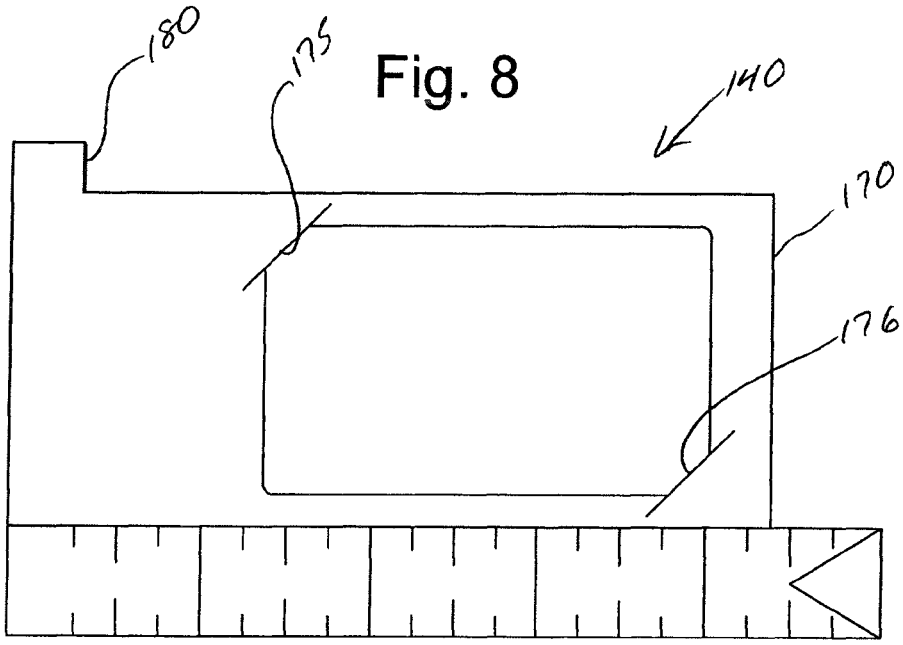
FIG. 8 is a front view of an alternative embodiment of the insert that includes slits for receiving corner portions of a gift card.
Figure 9:
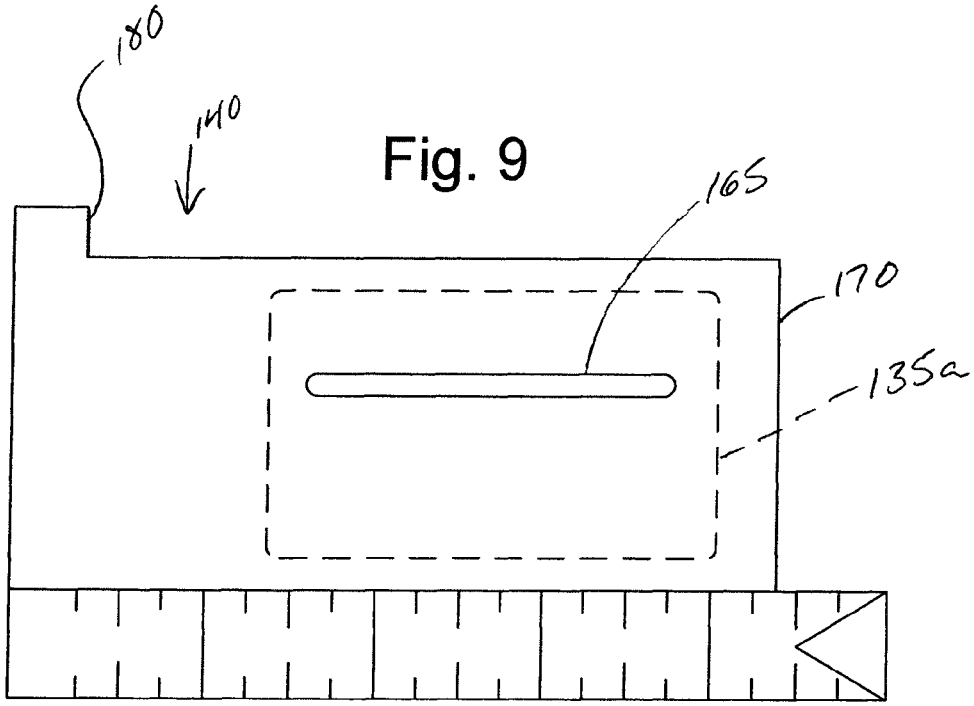
FIG. 9 is a front view of an alternative embodiment of the insert that includes a strip of adhesive for removably holding the gift card to the insert.

In another embodiment of the holder 100, the gift card 135 is attached to the insert 140 via removable adhesive, as shown in FIG. 9. In FIG. 9, a strip of adhesive 165 is shown on the wall 170 of the insert 140 and positioning of a gift card 135 upon the adhesive strip 165 is indicated in phantom lines 135*a*. The adhesive strip may be covered by a non-stick protective material that is peeled away prior to attaching the gift card 135 to the strip 165. The adhesive material of the strip 165 should allow the gift card 135 to be subsequently removed for use. In a further embodiment, the insert 140 may include slits of a size, number and placement to receive corner portions of the gift card 135 to thereby removably hold the gift card 135 to the insert 140. FIG. 8 is a front view of an alternative embodiment of the insert 140 that includes diagonally opposed slits 175 and 176 in the wall 170 of the insert 140 for receiving corner portions of a gift card 135.

The insert 140 also typically includes a means for stopping the insert 140 from being completely withdrawn from the enclosure of the main body 105. As shown in FIGS. 5, 6, 8, and 9, an insert 140 may be provided with a projection from the main portion 141 that serves as a stop 180 for retaining a portion of the insert proximate the stop 180 within the main body 105 when the insert 140 is withdrawn from the enclosure. In the illustrated embodiments, the stop 180 projects from an upper edge of the main portion 141. Alternatively, the stop 180 could comprise a piece of cardstock or the like adhered or otherwise attached to the main portion 141. As the insert 140 is withdrawn, the stop 180 moves toward the margin of the main body 105 and comes to abut a portion of the main body 105 adjacent the slot 107 where the front 110 and back 115 panels are sealed or otherwise attached to one another preventing passage of the stop 180 from within the enclosure. The stop 180 abuts the main body 105 when the insert 140 is fully withdrawn to retain a portion of the insert 140 within the main body 105.

Figure 7:
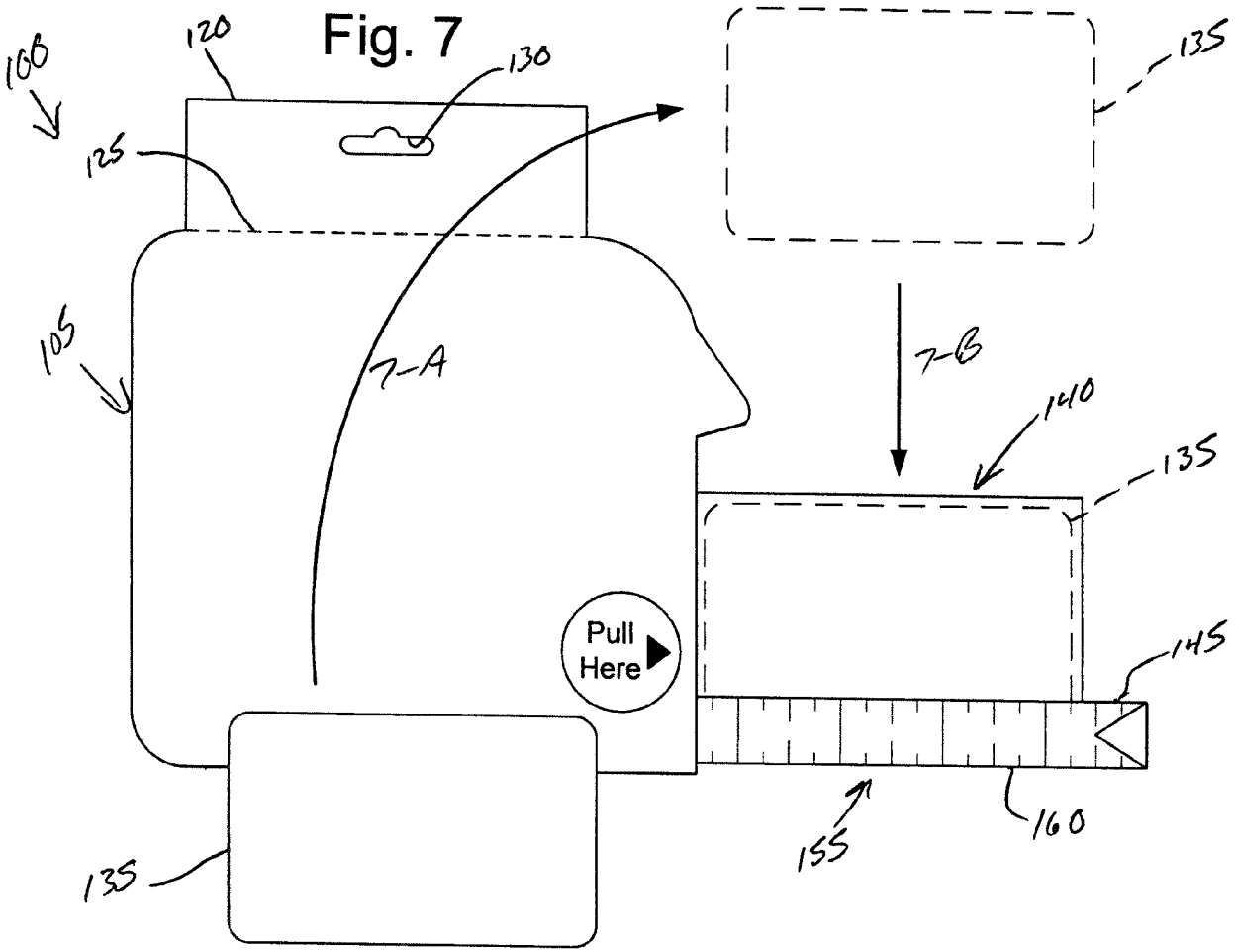
FIG. 7 is a front view of the gift card holder showing the insert withdrawn to receive a gift card removed from the front panel of the main body.

In use, the gift card holder 100 is typically presented for sale upon a display rack (not shown) with a display rack peg passed through the hole 130 in the hang tag 120. The holder 100 is removed from the display rack and taken to a cashier for purchase. As shown in FIGS. 1 and 7, the gift card 135 may be removably attached to the holder main body 105 so that the lower surfaces of the gift card 135 are unobstructed, thereby providing ready access to the gift card magnetic strip (not shown). At the point of purchase, the cashier may load or activate the gift card 135 by passing the magnetic strip through a conventional card reader (not shown) without the need to detach the gift card 135 from the holder 100.

Prior to giving the gift card 135 to a recipient, the purchaser and/or gift giver removes the gift card 135 from the main body 105 see arrow 7-A and attaches the card 135 to the wall 170 of the insert 140 or places the gift card 135 in the insert pocket 150, see arrow 7-B, as shown in FIG. 7. The hang tag 120 is then removed, typically by tearing along the perforated line 125 separating the hang tag 120 from the main body 105, and the insert 140 is pushed into the enclosure or inner space of the main body 105 so that only the tab 145 remains outside the enclosure as shown in FIG. 2.

Additional indicia or graphical or structural elements of the disclosed embodiments of the holder 100 may include instructions 185 for operation of the holder 100 or an angular projection 190 from the main body 105 shaped to simulate the lever or button of a tape measure.

Note that figures are not necessarily drawn to scale or to relative scale but are representative of aspects of one or more embodiments of the present invention.

The invention claimed is:

1. A transaction card holder comprising:

a main body comprising a first planar panel overlying and adhered to a second planar panel around the margins thereof and so that the margins of said first and second panels are substantially aligned and so that the first and second panels form an interior space therebetween;

an insert sized to receive and hold a gift card and to substantially fit within said interior space;

a slot along the margin of said main body for receiving said insert and to allow passage of said insert from a first position whereby said insert is substantially within said interior space to a second position whereby said insert is substantially withdrawn from said interior space;

a measuring scale provided on a surface of said insert so that said scale may be viewed when said insert is in said second position; and means for attaching a gift card to said insert so that said gift card may be positioned within said interior space when said insert is in said first position.

2. The card holder of claim 1, wherein said means for attaching said gift card to said insert includes a pocket formed in said insert.

3. The card holder of claim 1, wherein said means for attaching said gift card to said insert includes an adhesive.

4. The card holder of claim 1, wherein said means for attaching said gift card to said insert includes slits in said insert of a size, number and placement to receive two or more corner portions of said gift card.

5. The card holder of claim 1, wherein said main body further includes a hang tag projecting away from a margin of the main body and said hang tag separable from the main body along a perforated tear line.

6. The card holder of claim 2, wherein said pocket comprises an elongated measuring portion of said insert folded against a main portion of said insert.

7. The card holder of claim 6, wherein a gift card is partially inserted and held between said elongated measuring portion and said main portion.

8. The card holder of claim 1, further including a means for stopping said insert from complete withdrawal from said main body.

9. The card holder of claim 8, wherein said means for stopping comprises a projection from said main portion that abuts said main body when said insert is fully withdrawn to retain a portion of said insert within said main body.

10. The card holder of claim 8, wherein said means for stopping comprises a tab projecting away from a main portion of the insert.

11. The card holder of claim 5, wherein said hang tag includes a hole for hanging the gift card holder upon a display rack peg.

12. The card holder of claim 3, wherein said adhesive is covered by a non-stick protective material that is peeled away prior to attaching the gift card to the adhesive, with said adhesive allowing the gift card to be subsequently removed for use.

13. The card holder of claim 1, wherein said insert has a tab that projects out of the interior space allowing the user to grasp said tab.

14. The card holder of claim 1, wherein said gift card is engaged to the main body and said gift card being separable from the main body along a perforated tear line.

15. The card holder of claim 1, wherein said gift card has a magnetic strip that allows for the loading or activation of the gift card by passing said magnetic strip through a conventional card reader without detaching said gift card form the card holder.

* * * * *